United States Patent [19]

Reindel

[11] Patent Number: 4,990,870

[45] **Date of Patent: * Feb. 5, 1991**

[54] WAVEGUIDE BANDPASS FILTER HAVING A NON-CONTACTING PRINTED CIRCUIT FILTER ASSEMBLY

[75] Inventor: John Reindel, San Diego, Calif.

[73] Assignee: The United States of America as represented by the Secretary of the Navy, Washington, D.C.

[ * ] Notice: The portion of the term of this patent subsequent to Jan. 30, 2007 has been disclaimed.

[21] Appl. No.: 432,437

[22] Filed: Nov. 6, 1989

[51] Int. Cl.[5] ..... H01P 1/207

[52] U.S. Cl. ..... 333/208; 333/248

[58] Field of Search ..... 333/208–212, 333/204, 248, 246, 239; 455/328, 327

[56] References Cited

U.S. PATENT DOCUMENTS

| | | | |
|---|---|---|---|
| 3,657,670 | 4/1972 | Kitazume et al. | 333/208 |
| 3,754,198 | 8/1973 | Anghel | 333/204 |
| 4,028,650 | 6/1977 | Konishi et al. | 333/208 |
| 4,188,594 | 2/1980 | Bongianni | 332/16 R |
| 4,233,579 | 11/1980 | Carlson et al. | 333/204 |
| 4,264,881 | 4/1981 | De Ronde | 333/204 X |
| 4,521,755 | 6/1985 | Carlson et al. | 333/204 X |
| 4,539,490 | 9/1985 | Ariizumi et al. | 307/296 R |
| 4,540,960 | 9/1985 | Giordano | 333/228 |
| 4,873,501 | 10/1989 | Hislop | 333/208 X |
| 4,897,623 | 1/1990 | Reindel | 333/208 |

*Primary Examiner*—Eugene R. LaRoche
*Assistant Examiner*—Seung Ham
*Attorney, Agent, or Firm*—Harvey Fendelman; Thomas Glenn Keough

[57] ABSTRACT

A waveguide bandpass filter employs a waveguide section and a printed circuit filter assembly having a dielectric substrate positioned in the waveguide between the narrow walls thereof and a row or array of half-wavelength conductive metal plate elements lying in a surface plane of the dielectric substrate that is oriented substantially parallel to narrow walls and orthogonal to broad walls of the waveguide. The half-wavelength conductive metal plate elements, defining a parallel resonant array, are spaced in non-conductive relation from one another and from the broad and narrow walls of the waveguide so as to divide and transform a dominant waveguide propagation mode into a transformed propagation mode that approximates upper and lower microstrip sections interconnected by a metallic conductor. The filter also includes a pair of elongated foam dielectric bodies disposed in the waveguide and mounting therebetween the dielectric substrate and half-wavelength conductive plate elements thereon, and a pair of quarter-wavelength conductive metal plate elements on the dielectric substrate which are conductively connected to outermost ones of the half-wavelength conductive plate elements for defining impedance matching transformers adjacent input and output ends of the waveguide.

15 Claims, 3 Drawing Sheets

WAVEGUIDE BANDPASS FILTER HAVING A NON-CONTACTING PRINTED CIRCUIT FILTER ASSEMBLY

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATION

Reference is hereby made to the following copending application dealing with related subject matter and assigned to the assignee of the present invention: "Non-Contacting Printed Circuit Waveguide Elements" by John Reindel, assigned U.S. Ser. No. 07/181,126 and filed Apr. 13, 1988.

BACKGROUND OF THE INVENTION

The present invention generally relates to the field of waveguides and, more particularly, to a waveguide bandpass filter having a non-contacting printed circuit filter assembly.

Conventional waveguide filters use elements that are in electrical and mechanical contact with the waveguide walls. Typical examples of these types of filters include inductive posts and inductive irises. These reactive elements are realized by means of metal rods or plates that are inserted into carefully machined openings and bonded to the walls of the waveguide by means of soldering, welding or compression techniques.

Newer printed circuit waveguide filters also use such elements printed on substrates that are held suspended between the waveguide walls with firm metallic contacts at the walls. These filters, known as fin-line filters, are simpler to make than inductive irises and posts but also require very precise machining to split the waveguide and cut the groove for supporting the substrate.

Because the above-described types of filters are in contact with the waveguide walls and because current flow in the junctions between the elements and the waveguide walls, and because of junction imperfections, the filter loss and reflection quality are often degraded. The waveguide filter of the application cross-referenced above overcomes the foregoing problems associated with conventional waveguide filters by providing a printed circuit filter element that does not require any contact with the waveguide walls.

This non-contacting printed circuit waveguide filter can be assembled by inserting a foam backed printed circuit within a short section of waveguide. The printed circuit is formed on a dielectric substrate which is positioned within the waveguide by means of dielectric foam spacer material. The filter facilitates very simple assembly techniques and eliminates practically all costly machining that is usually associated with waveguide filters. It also provides the highest attainable performance in terms of low losses and high reflection because the losses due to element contact resistance are eliminated.

SUMMARY OF THE INVENTION

The present invention relates to a waveguide which employs a non-contacting printed circuit filter assembly of half-wavelength conductive elements for providing a bandpass filter. The bandpass filter of the present invention employs a simple method of construction which eliminates machining by utilizing a "push-in" printed circuit substrate and an open waveguide thereby reducing cost of waveguide filters considerably. Further, design accuracy is enhanced by employment of conventional lithographics and chemical etching techniques.

The dipole-like filter of the cross-referenced application can be characterized as a series resonant structure and is therefore useful primarily for band reject, or stopband, filters. In contrast thereto, bandpass filters generally require a parallel resonant structure. It is feasible to achieve bandpass characteristics with the above-referenced dipole filter by using a series combination of two filters, a low pass filter and a high pass filter. Disadvantageously, this approach requires doubling the number of elements used and, therefore, may be more lossy.

The filter assembly employed in the non-contacting waveguide filter of the present invention provides a bandpass filter by use of a printed circuit substrate composed of an array of half-wavelength metal plate elements on a dielectric substrate. The printed circuit substrate is positioned in the waveguide between the broad walls thereof by means of dielectric foam spacer material.

The half-wavelength metal plate elements constitute low impedance sections, whereas the slots between the plate elements constitute high impedance sections. The magnitude of the impedance variations determines the bandwidth of the filter. The plate elements can be of enlarged size and bent inwardly from their lower and upper edges along the waveguide broad walls to create two microstrip sections interconnected by a metallic conductor and having impedances as low as a few ohms and thereby achieve the desired ratio of high to low impedances.

Also, since the filter high impedance sections are equal to that of the open waveguide, matching transformers are used between the filter assembly and the input and output of the waveguide. The matching transformers are quarter-wavelength plate elements with heights determined by the mean of the filter impedances.

OBJECTS OF THE INVENTION

Accordingly, it is the primary object of the present invention to disclose a bandpass waveguide filter with a non-contacting filter assembly.

Another object of the present invention is to disclose a non-contacting filter assembly providing a parallel resonant structure.

Still another object of the present invention is to disclose a parallel resonant structure in a bandpass waveguide filter which takes the form of a printed circuit substrate composed of an array of half-wavelength metal plate elements on a dielectric substrate.

A further object of the present invention is to disclose a non-contacting filter assembly having matching transformers in the form of quarter-wavelength plate elements at the opposite ends of the filter assembly.

Other objects, advantages and novel features of the invention will become apparent from the following detailed description of the invention when considered in conjunction with the accompanying drawings.

DETAILED DESCRIPTION OF THE INVENTION

Figure 1:
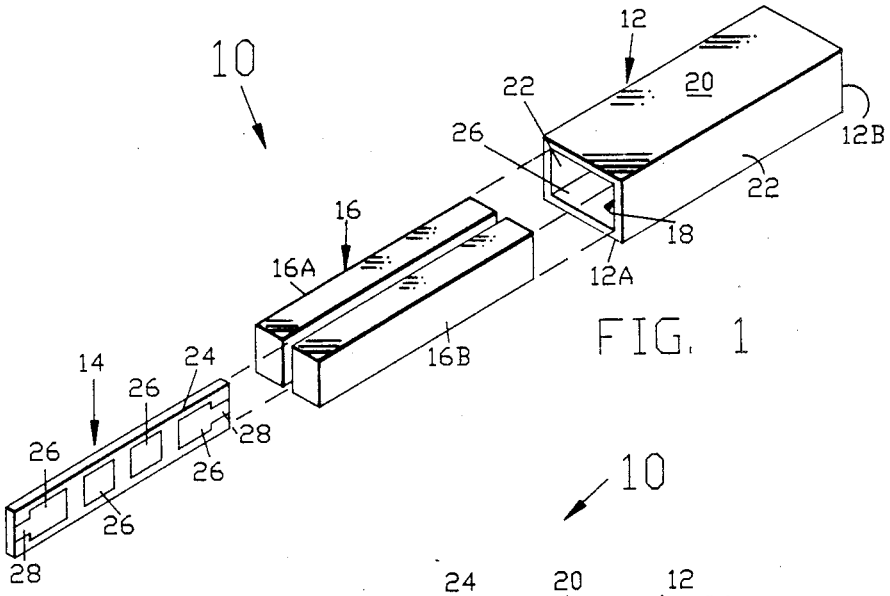
FIG. 1 is an exploded perspective view of a waveguide bandpass filter employing a non-contacting printed circuit filter assembly in accordance with the present invention.
Figure 2:
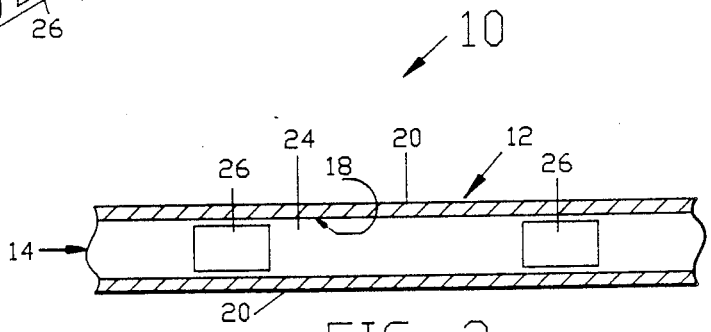
FIG. 2 is an enlarged fragmentary longitudinal sectional view of the filter of FIG. 1.

Referring now to the drawings, and particularly to FIGS. 1 and 2, there is shown a waveguide bandpass filter, generally designated 10, constructed in accordance with the present invention. Waveguide bandpass filter 10 includes a rectangular hollow tubular waveguide section 12, a printed circuit filter assembly 14 and a dielectric foam block 16 for mounting filter assembly 14 in the interior cavity 18 of waveguide section 12.

More particularly, waveguide section 12 is composed of a suitable electrically conductive metal and includes a pair of opposing broad walls 20 and a pair of opposing narrow walls 22. Narrow walls 22 extend orthogonally between and interconnect broad walls 20 to define the hollow cavity 18 for propagating electromagnetic signals in a dominant waveguide propagation mode, such as the $TE_{10}$ mode, within the waveguide section 12 in the longitudinal direction of hollow cavity 18. Dielectric foam block 16 which mounts printed circuit filter assembly 14 is composed of a pair of separate, preferably identical elongated foam dielectric bodies 16A, 16B. Foam dielectric bodies 16A, 16B have respective cross-sectional sizes permitting their insertion into waveguide interior cavity 18 with filter assembly 14 sandwiched between them.

Printed circuit filter assembly 14 constitutes a parallel resonant structure which divides and transforms the dominant $TE_{10}$ propagation mode of waveguide 12 into a transformed propagation mode that approximates two parallel (upper and lower) microstrip sections being interconnected by a metallic conductor and disposed along opposing broad walls 20 of waveguide section 12 so as to provide bandpass filtering of the electromagnetic signals propagating through waveguide interior cavity 18. The parallel resonant structure has a design that is suitable for a wide range of bandpass applications. The design is suitable for filters having one to thirty percent pass band.

Filter assembly 14 is constructed of a substantially planar dielectric substrate 24 and an array of half-wavelength conductive elements 26 in the form of rectangular-shaped metal plate elements attached on a side or surface 24A of substrate 24 so as to all lie in the common plane of substrate surface 24A. Plate elements 26 are spaced in non-conductive relation from one another.

Printed circuit filter assembly 14, composed of dielectric substrate 24 with conductive plate elements 26 thereon, is positioned within waveguide interior cavity 18 in a centered relation between narrow walls 22 of the waveguide section 12 by foam dielectric bodies 16A, 16B of block 16. Filter assembly 14 extends between broad walls 20 of waveguide section 12 with the plane of dielectric substrate surface 24A and conductive plate elements 26 thereon oriented substantially parallel to narrow walls 22 and orthogonal to broad walls 20 of waveguide section 12. In addition to being spaced in non-conductive relation from each other, half-wavelength plate elements 26 are spaced in non-conductive relation from broad and narrow walls 20, 22 of waveguide 12 so as to divide and transform the dominant $TE_{10}$ propagation mode into a transformed propagation mode that approximates two upper and lower microstrip (or psuedo-microstrip) sections which are interconnected by a metallic conductor. The impedance is thereby varied from that of open waveguide section 12 to that determined by the slot lines between the center ridge and broad wall 20 of waveguide section 12.

The magnitude of the impedance variations determine the bandwidth of filter 10. The region of open waveguide section 12 between plate elements 26 has high impedance, whereas plate elements 26 have low impedance. The ratio of high impedance to low impedances must be in the order of ten to thirty for filters with pass bands of one to three percent. The open waveguide impedance is related to the width of the waveguide, the frequency and the guide aspect ratio and can approach the free space impedance, or 377 ohms.

Figure 3:
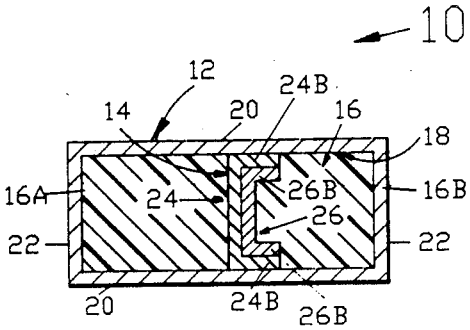
FIG. 3 is an enlarged cross-sectional view of the filter of the present invention, illustrating a modified configuration of the filter assembly.
Figure 4:
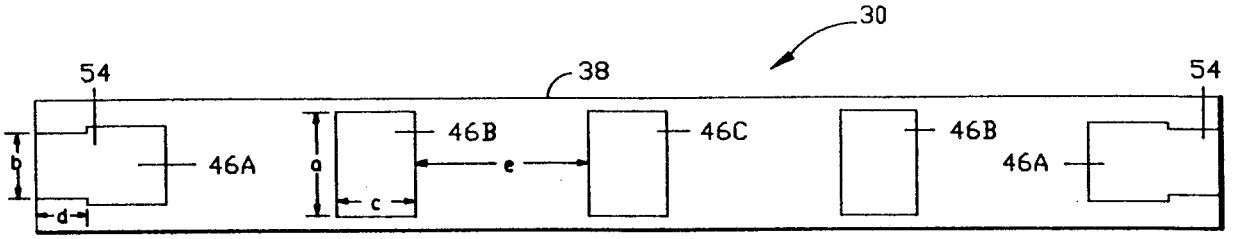
FIG. 4 is a side elevational view of the printed circuit filter assembly having conductive plate elements of a first set of sizes.
Figure 5:
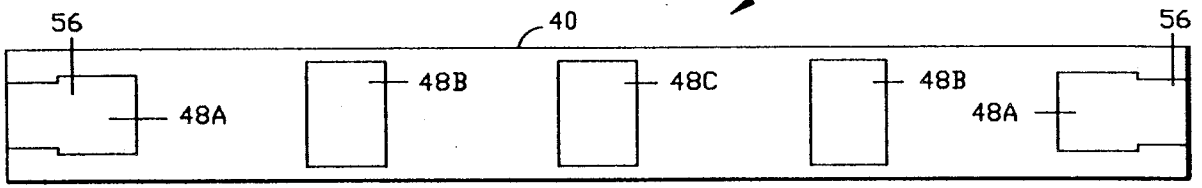
FIG. 5 is a side elevational view of the printed circuit filter assembly having conductive plate elements of a second set of sizes.
Figure 6:
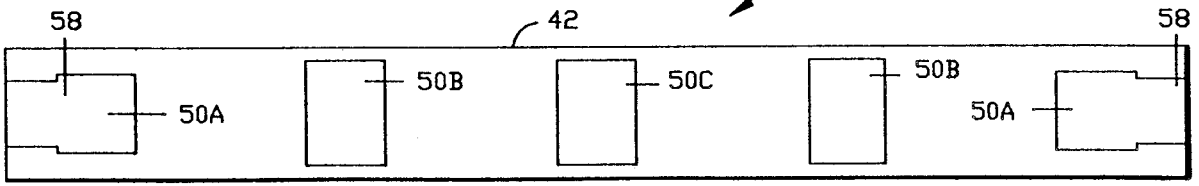
FIG. 6 is a side elevational view of the printed circuit filter assembly having conductive plate elements of a third set of sizes.
Figure 7:
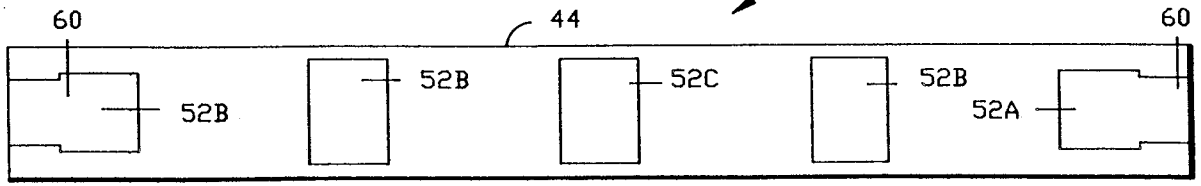
FIG. 7 is a side elevational view of the printed circuit filter assembly having conductive plate elements of a fourth set of sizes.

To better achieve the required impedance ratio, the half-wavelength plate element impedances can be lowered by increasing their heights and bending the lower and upper edges thereof along waveguide broad walls 20. FIG. 3 shows an alternative form of the printed circuit filter assembly 14 which incorporates this modification. Dielectric substrate 24 and half-wavelength conductive plate elements 26 include respective middle portions 24A, 26A and opposite lower and upper edge portions 24B, 26B. The middle portions 24A, 26A extend between the waveguide broad walls 20 in substantially orthogonal relation thereto. The opposite lower and upper edge portions 24B, 26B are bent so as to extend in substantially orthogonal relation to the middle portions 24A, 26A and in parallel relation to one another and to the waveguide broad walls 20. In such configuration, the lower and upper edge portions 26B of the half-wavelength conductive plate elements 26 spaced from the lower and upper broad walls 20 by the lower and upper portions 24B of the dielectric substrate 24 more dramatically define the two upper and lower microstrip sections.

The filter high impedance sections are equal to that of the open waveguide. It is therefore necessary to use matching impedance transformers 28 between the array of plate elements 26 of filter assembly 14 and input and ouput ends 12A, 12B of waveguide section 12. Referring again to FIG. 1, it can be seen that matching impedance transformers 28 are in the form of a pair of quarter-wavelength conductive metal plate elements 28 on dielectric substrate 24. Quarter-wavelength plate elements 28 are conductively connected to outermost ones of the half-wavelength conductive plate elements 26. The height of quarter-wavelength plate elements 28 is determined by the mean of the filter impedance.

The present invention extends the use of a noncontacting filter assembly to include bandpass filters. The simple construction of the "push-in" printed circuit filter assembly 14 and an open waveguide section 12 will reduce costs of waveguide filters considerably. Printed circuit filter assembly 14 is particularly applicable and advantageous to millimeter waveguide filters because it eliminates machining requirements and achieves design accuracy by means of lithographics and chemical etching techniques.

FIGS. 4–7 illustrate a family of filter assemblies 30, 32, 34 and 36 having dielectric substrates 38, 40, 42 and 44, half-wavelength conductive plate elements 46, 48, 50 and 52, and impedance matching quarter-wavelength conductive plate elements 54, 56, 58 and 60. Half-wavelength conductive plate elements 46, 48, 50 and 52 of each filter assembly 30, 32, 34 and 36 progressively decrease in height ("a" in FIG. 4) from middle plate elements 46C, 48C, 50C and 52C to outermost plate elements 46A, 48A, 50A and 52A, whereas the heights ("b" in FIG. 4) of quarter-wavelength plates 54, 56, 58 and 60 of each filter assembly 30, 32, 34 and 36 are equal. Furthermore, the heights of outermost half-wavelength plate elements 46A-52A of each filter assemby 30–36 are equal, and the heights of intermediate half-wavelength plate elements 46B, 48B, 40B and 52B of each filter assembly 30, 32, 34 and 36 are equal. The lengths ("c" in FIG. 4) of half-wavelength plate elements 46, 48, 50 and 52 of all filter assemblies 30, 32, 34 and 36 are equal and the lengths ("d" in FIG. 4) of quarter-wavelength plate elements 54, 56, 58 and 60 of all filter assemblies 30, 32, 34 and 36 are equal. The distances ("e" in FIG. 4) between the half-wavelength plate elements 46, 48, 50 and 52 are equal.

Figure 8:
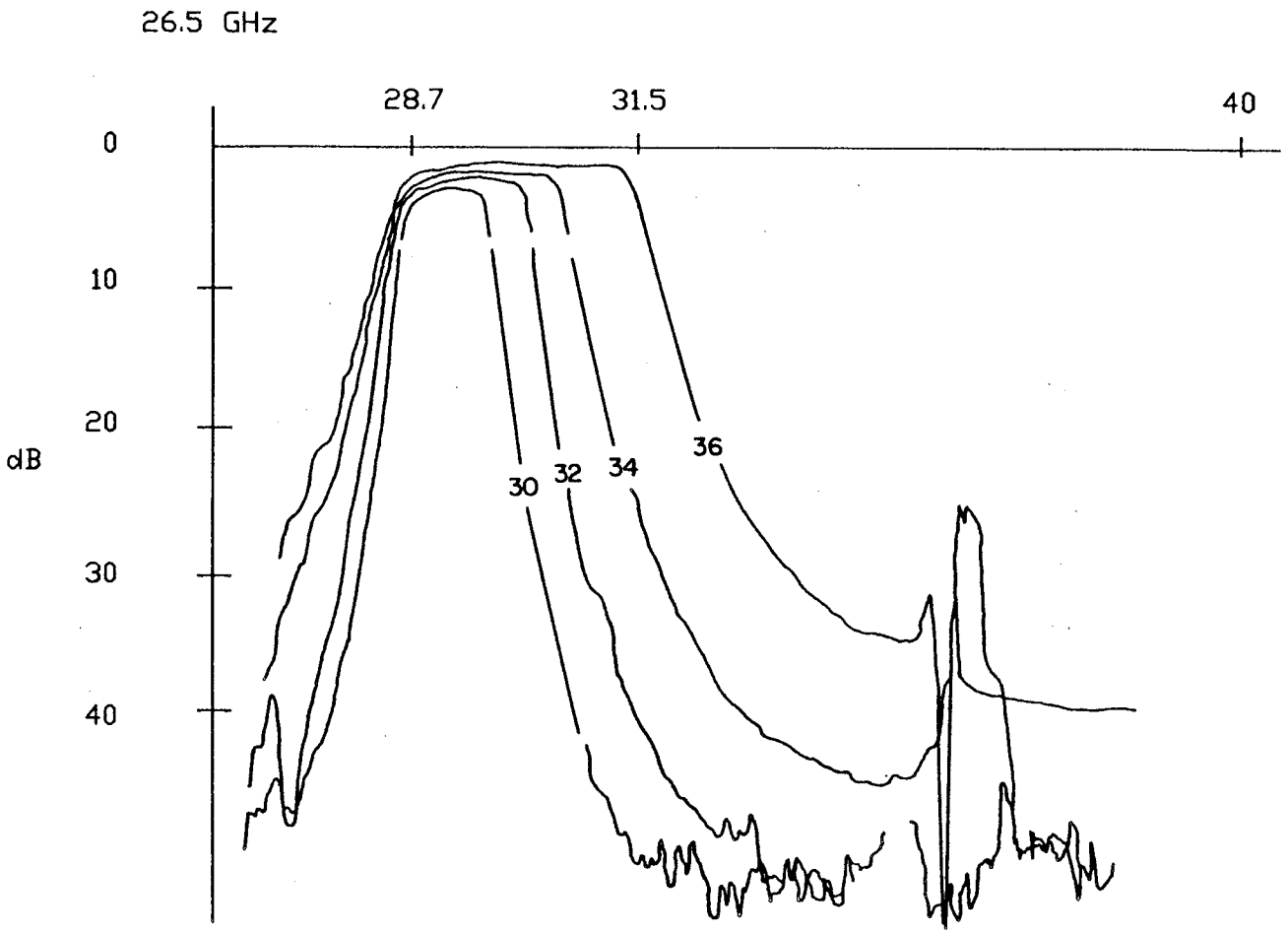
FIG. 8 is a graph of attenuation versus frequency of waveguide bandpass filters incorporating the printed circuit filter assemblies of FIGS. 4–7.

Referring to FIG. 8, there is presented a graph of attenuation versus frequency curves of waveguide bandpass filters incorporating filter assemblies 30, 32, 34 and 36 of FIGS. 4–7. The curves are identified with the corresponding reference numerals of the particular filter assemblies which produced them. It can be seen that a waveguide bandpass filter containing filter assembly 36 having half-wavelength plate elements 52 of greatest height has the largest bandpass of 28.7 to 31.5 GHz, whereas the filter containing filter assembly 30 having half-wavelength plate elements 46 of smallest height has the smallest bandpass.

The values of the dimensions "a" to "e" and of the thicknesses of the half-wavelength (½ WL) and quarter-wavelength (¼ WL) plate elements of the filter assemblies of FIGS. 4–7 which produced the curves shown in FIG. 8 are as follows:

Filter Assembly 30

| ¼ WL Elements | ½ WL Elements | | | |
|---|---|---|---|---|
| Dimension (in.) | 46A | 46B | 46C | 54 |
| thickness | .005 | .005 | .005 | .005 |
| height "a" | .102 | .122 | .130 | |
| length "c" | .100 | .100 | .100 | |
| height "b" | | | | .085 |
| length "d" | | | | .060 |
| distance "e" | .200 | .200 | .200 | |

Filter Assembly 32

-continued

| ¼ WL Elements | ½ WL Elements | | | |
|---|---|---|---|---|
| Dimension (in.) | 48A | 48B | 48C | 56 |
| thickness | .005 | .005 | .005 | .005 |
| height "a" | .110 | .132 | .143 | |
| length "c" | .100 | .100 | .100 | |
| height "b" | | | | .100 |
| length "d" | | | | .060 |
| distance "e" | .200 | .200 | .200 | |

Filter Assembly 34

| ¼ WL Elements | ½ WL Elements | | | |
|---|---|---|---|---|
| Dimension (in.) | 50A | 50B | 50C | 58 |
| thickness | .005 | .005 | .005 | |
| height "a" | .125 | .145 | .153 | |
| length "c" | .100 | .100 | .100 | |
| height "b" | | | | .105 |
| length "d" | | | | .060 |
| distance "e" | .200 | .200 | .200 | |

Filter Assembly 36

| ¼ WL Elements | ½ WL Elements | | | |
|---|---|---|---|---|
| Dimension (in.) | 52A | 52B | 52C | 60 |
| thickness | .005 | .005 | .005 | |
| height "a" | .128 | .155 | .161 | |
| length "c" | .100 | .100 | .100 | |
| height "b" | | | | .100 |
| length "d" | | | | .060 |
| distance "3" | .200 | .200 | .200 | |

The term "half-wavelength" used to characterize the conductive plate elements 26, 46, 48, 50 and 52 and the term "quarter-wavelength" used to characterize the conductive elements 28, 54, 56, 58 and 60 are in reference to the dimensions "c" and "d" respectively illustrated in FIGS. 4–7. The "half-wavelength" is $\lambda_g/2$ and the "quarter-wavelength" is $\lambda_g/4$, where $\lambda_g$ is generally the wavelength at the midband operating frequency of the section of waveguide containing the filter of the present invention and where:

$$\lambda_g = \lambda/\sqrt{1-(\lambda/\lambda_c)^2}$$

$\lambda = f/V_o$ $v_o$ = speed of light $\lambda c = 2a$ a = broadwall inside extent between sidewalls, and f = frequency at midband operating frequency of the waveguide section.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely exemplary embodiments thereof.

Having thus described the invention, what is claimed is:

1. A waveguide bandpass filter, comprising:

a hollow tubular waveguide section having a plurality of walls for propagating electromagnetic signals in a dominant waveguide propagation mode; and a printed circuit filter assembly spaced in nonconductive relation from said waveguide walls for dividing and transforming the dominant waveguide propagation mode of said waveguide section into a transformed propagation mode other than said dominant waveguide propagation mode along a pair of opposite ones of said waveguide walls so as to provide bandpass filtering of the signals;

said printed circuit filter assembly including an elongated dielectric substrate positioned in said waveguide section between said pair of waveguide walls and having a surface plane that is oriented orthogonal to said pair of waveguide walls, and an array of conductive elements on said dielectric substrate, said elements being spaced in non-conductive relation from one another and from said pair of waveguide walls.

2. The waveguide bandpass filter of claim 1 wherein said transformed propagation mode approximates that of a pair of spaced adjacent microstrip sections.

3. The waveguide bandpass filter of claim 1 wherein said transformed propagation mode approximates that of a pair of microstrip sections interconnected by a metallic conductor.

4. The waveguide bandpass filter of claim 1 further comprising:

a pair of elongated foam dielectric bodies disposed in said waveguide and mounted between said printed circuit filter assembly and said waveguide walls.

5. The waveguide bandpass filter of claim 1 wherein said printed circuit filter assembly further comprises:

impedance matching means conductively connected to opposite ends of said conductive elements and wherein said conductive elements are half-wavelength conductive elements.

6. The waveguide bandpass filter of claim 5 wherein said impedance matching means includes a pair of quarter-wavelength conductive elements.

7. The waveguide bandpass filter of claim 6 wherein said printed circuit filter assembly further comprises:

impedance matching means on said dielectric substrate being conductively connected to outermost ones of said half-wavelength conductive elements.

8. The waveguide bandpass filter of claim 7 wherein said impedance matching means includes a pair of quarter-wavelength conductive elements.

9. The waveguide bandpass filter of claim 6 wherein said dielectric substrate and said half-wavelength conductive elements include respective middle portions extending between said pair of waveguide walls in substantially orthogonal relation thereto and respective opposite edge portions that are bent to extend in substantially orthogonal relation to said respective middle portions and in parallel relation to one another and to said pair of waveguide walls such that said transformed propagation mode approximates a pair of spaced microstrip sections interconnected by a metallic conductor.

10. The waveguide bandpass filter of claim 6 further comprising:

a pair of elongated foam dielectric bodies disposed in said waveguide section and mounted between said dielectric substrate and said walls.

11. A waveguide bandpass filter, comprising:

a rectangular waveguide section having first and second broad walls and first and second narrow walls disposed orthogonal to and between said first and second broad walls for propagating electromagnetic signals in a dominant waveguide propagation mode between said walls; and a printed circuit filter assembly including a dielectric substrate substantially centered in said waveguide section between said narrow walls thereof, extending between said broad walls thereof, and having a surface plane that is oriented substantially parallel to said waveguide narrow walls and orthogonal to said waveguide broad walls, and an array of half-wavelength conductive metal plate elements on said dielectric substrate lying in said surface plane, said plate elements being spaced in non-conductive relation from one another and from said broad and narrow walls of said waveguide section so as to divide and transform the dominant waveguide propagation mode into a transformed propagation mode which approximates two adjacent microstrip sections along said first and second waveguide broad walls.

12. The waveguide bandpass filter of claim 11 further comprising:

a pair of elongated foam dielectric bodies disposed in said waveguide section and mounted adjacent said dielectric substrate.

13. The waveguide bandpass filter of claim 11 wherein said printed circuit filter assembly further comprises:

impedance matching means conductively connected to outermost ones of said half-wavelength conductive plate elements in said array.

14. The waveguide bandpass filter of claim 13 wherein said impedance matching means includes a pair of quarter-wavelength conductive metal plate elements on said dielectric substrate being conductively connected to said outermost ones of said half-wavelength conductive plate elements for defining impedance matching transformers adjacent said input and output ends of said waveguide section.

15. The waveguide bandpass filter of claim 11 wherein said dielectric substrate and said half-wavelength conductive plate elements include respective middle portions extending between said waveguide broad walls in substantially orthogonal relation thereto and respective opposite edge portions that are bent to extend in substantially orthogonal relation to said respective middle portions and in parallel relation to one another and to said waveguide broad walls such that said transformed propagation mode approximates said pair of microstrip sections interconnected by a metallic conductor.

* * * * *